US006244582B1

(12) United States Patent
Marcolina

(10) Patent No.: US 6,244,582 B1
(45) Date of Patent: Jun. 12, 2001

(54) SYSTEM AND METHOD FOR ALTERING THE SIZE AND CONFIGURATION OF A TRADITIONAL CARPENTER'S CLAMP

(76) Inventor: Dante A. Marcolina, 121 Bethelehem Pike, Philadelphia, PA (US) 19118

( * ) Notice: Subject to any disclaimer, the term of this patent is extended or adjusted under 35 U.S.C. 154(b) by 0 days.

(21) Appl. No.: 09/404,695

(22) Filed: Sep. 24, 1999

(51) Int. Cl.[7] ..... B25B 1/24
(52) U.S. Cl. ..... 269/283; 269/219; 269/221
(58) Field of Search ..... 81/423, 424, 185.1, 81/124.2, 176.2; 269/283, 280, 279, 219, 220, 221, 249; 254/133 R, 134

(56) References Cited

U.S. PATENT DOCUMENTS

| | | | | |
|---|---|---|---|---|
| D. 264,300 | * | 5/1982 | Imm | 81/176.2 |
| 1,781,997 | * | 11/1930 | Berezowski | 269/283 |
| 2,671,366 | | 3/1954 | Beusch . | |
| 3,499,206 | * | 3/1970 | Quernheim | 268/283 |
| 3,767,183 | * | 10/1973 | Van Gelder | 269/283 |
| 4,265,436 | * | 5/1981 | Wagster | 269/283 |
| 4,580,769 | | 4/1986 | Pappas . | |
| 5,335,898 | | 8/1994 | Johnson . | |
| 5,697,268 | * | 12/1997 | Makovsky et al. | 81/176.2 |
| 5,921,536 | * | 7/1999 | Bernstein | 269/283 |
| 5,996,447 | * | 12/1999 | Baymouth | 81/176.2 |

* cited by examiner

*Primary Examiner*—Robert C. Watson
(74) *Attorney, Agent, or Firm*—LaMorte & Associates

(57) ABSTRACT

A system for an extension device that attaches to hand screw clamps and similarly configured clamps. Hand screw clamps have two jaw elements that are interconnected by two threaded shafts. As the threaded shafts are turned, the jaw elements can be biased toward one another in a variety of configurations. The system includes a first tubular element having an open end. Two opposing slots are present on the first tubular element that extend inwardly a predetermined distance from the open end. The open end of the first tubular element is sized to receive a first of the jaw elements of the hand screw clamp, wherein the threaded screws of the hand screw clamp pass into the slots. The system also includes a second tubular element having an open end and two opposing slots that extend inwardly a predetermined distance from that open end. The open end of the second tubular element is sized to receive a second of the jaw elements therein. The first and second tubular extension elements extend beyond the length of the jaw elements of the hand screw clamp, changing the size and/or configuration of the clamp.

15 Claims, 4 Drawing Sheets

SYSTEM AND METHOD FOR ALTERING THE SIZE AND CONFIGURATION OF A TRADITIONAL CARPENTER'S CLAMP

BACKGROUND OF THE INVENTION

1. Field of the Invention

In general, the present invention relates to clamps of the type that are commonly used by carpenters to bias pieces of wood together. More particularly, the present invention relates to auxiliary devices that attach to traditional clamps to expand the versatility of the such clamps.

2. Description of the Prior Art

Carpenters, builders, cabinet makers and other professionals that build items from wood often use clamps to temporarily hold pieces of wood together. Often objects made of wood require different pieces of wood to be glued together. Clamps are commonly used to bias glued pieces of wood together as the glue cures.

The prior art is replete with a variety of different clamps that are designed for specific purposes. It is impractical for a carpenter to have a large collection of specialty clamps available, being that the specialty clamps are rarely needed. Rather, many carpenters commonly have a collection of general purpose clamps that they adapt to different needs. One of the most common types of general purpose clamps used by carpenters is the hand screw clamp. Hand screw clamps are also commonly known as dual screw clamps and carpenters clamps.

Referring to FIG. 1, a traditional hand screw clamp 10 is shown. The hand screw clamp 10 contains two threaded shafts 12 that pass in parallel through two wooden jaw elements 14, 16. Each of the threaded shafts 12 terminate at one end with a handle 18. Each of the threaded shafts 12 engages the wooden jaw that is farthest away from the handle 18 of that threaded shaft 12. By selectively turning the threaded shafts 12, the two wooded jaws 14, 16 can be biased toward each other at a variety of different angles.

A problem associated with hand screw clamps and similarly constructed clamps, is that the threaded shafts pass between the two wooden jaws. Accordingly, a work piece can only be placed in between the wooden jaws in the areas not obstructed by the threaded shafts. This provides traditional hand screw clamps with an effective clamping range of only a few inches. Accordingly, traditional hand screw clamps are not commonly used to clamp large objects that require a clamping force to be applied several inches from the edge of that object.

In the prior art, there have been auxiliary devices invented that are intended to improve the range and versatility of different types of clamps. One such auxiliary device for a hand screw clamp is shown in U.S. Pat. No. 5,335,898 to Johnson, entitled Apparatus And Method For Clamping Structural Members During Joinder. Such a device does enable a hand screw clamp to clamp together objects otherwise not capable of being clamped by a hand screw clamp. However, to utilize the auxiliary extension, dowel holes must be drilled in the wood being clamped. Accordingly, such auxiliary attachments only have limited applications.

A need therefore exists for an auxiliary device that can be added to a clamp that significantly increases the range and versatility of the clamp without having to modify the wood being clamped. This need is met by the present invention as is described and claimed below.

SUMMARY OF THE INVENTION

The present invention is a system and associated method of use for an extension device that attaches to hand screw clamps and similarly configured clamps. Hand screw clamps have two jaw elements that are interconnected by two threaded shafts. As the threaded shafts are turned, the jaw elements can be biased toward each other in a variety of configurations. The system includes a first tubular element having an open end. Two opposing slots are present on the first tubular element that extend inwardly a predetermined distance from the open end. The open end of the first tubular element is sized to receive a first of the jaw elements of the hand screw clamp, wherein the threaded shafts of the hand screw clamp pass into the slots.

The system also includes a second tubular element having an open end and two opposing slots that extend inwardly a predetermined distance from that open end. The open end of the second tubular element is sized to receive a second of the jaw elements therein. The first and second tubular extension elements extend beyond the length of the jaw elements of the hand screw clamp. The first and second tubular extension elements can also have different configurations, thereby altering the configuration of the clamp. The present invention therefore enables a single clamp to be configured into multiple different lengths and configurations.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention clamp extension system can be adapted to several types of prior art clamps, it is particularly well suited for use with hand screw clamps. Accordingly, by way of example, the present invention clamp extension system will be described in conjunction with a hand screw clamp in order to set forth the best mode contemplated for the invention.

Figure 1:
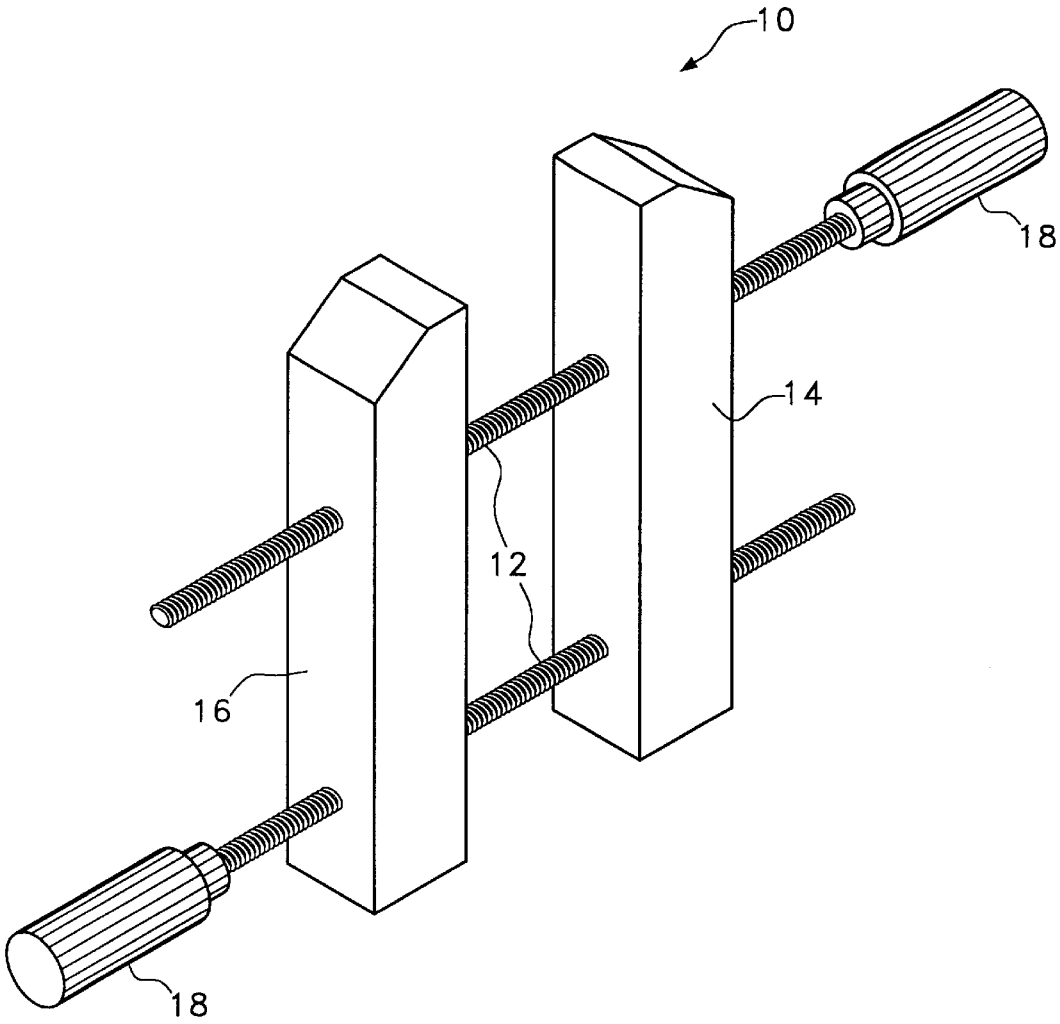
FIG. 1 is perspective view of a traditional prior art hand screw clamp.
Figure 2:
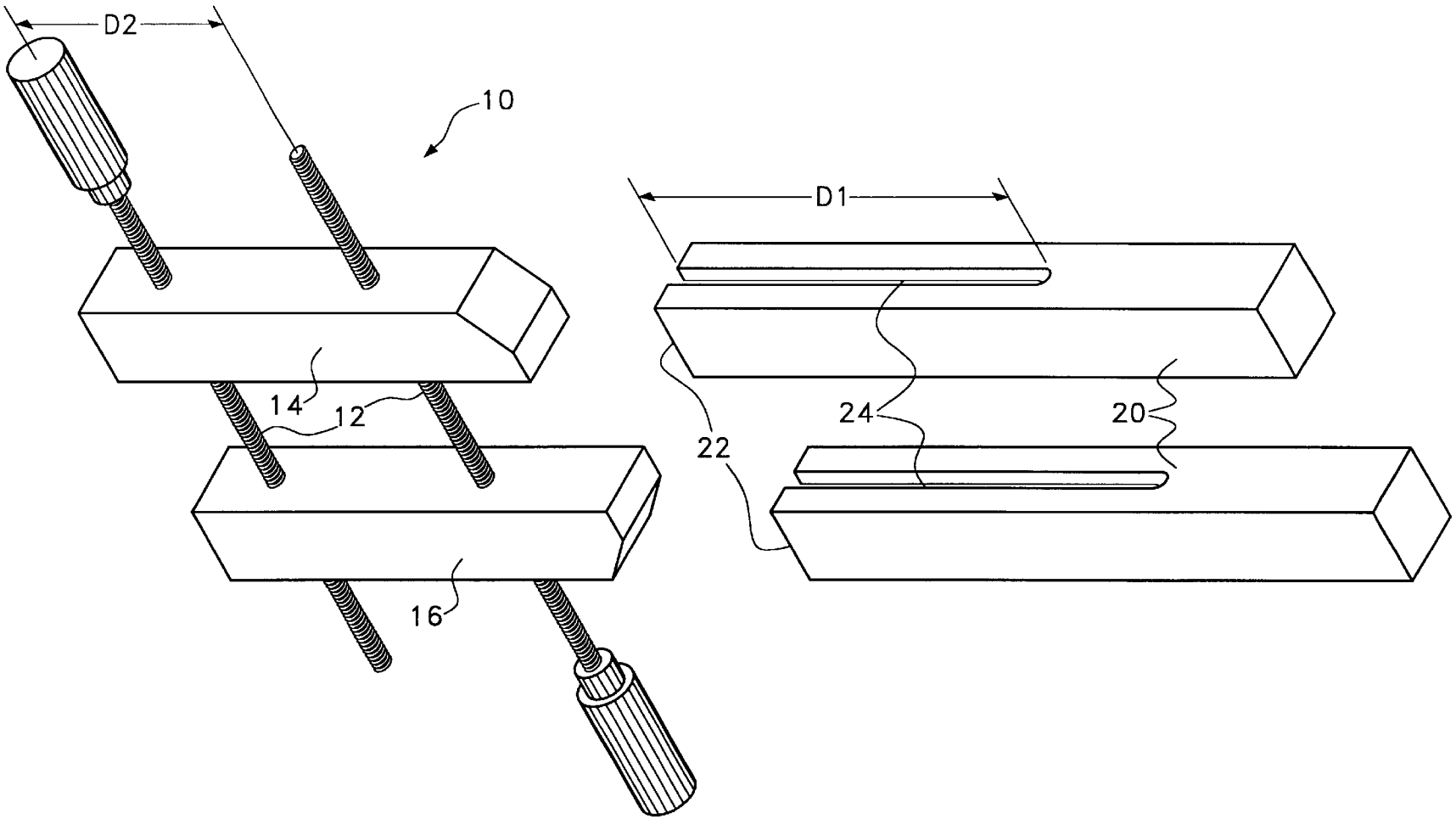
FIG. 2 is perspective view of an exemplary embodiment of a clamp extension system in accordance with the present invention.

Referring to FIG. 2, a traditional hand screw clamp is shown of the type previously described in FIG. 1. Components of the hand screw clamp referenced will use the same reference numerals as was used in the description of FIG. 1.

In FIG. 2, it can be seen that the present invention clamp extension system includes two tubular extension arms 20. The front ends 22 of the two tubular extension arms 20 are open. The interior of the tubular extension arms 20 are hollow and define an interior area that has a cross-sectional area that is larger than the cross-sectional area of the wooden jaws 14, 16 of the hand screw clamp 10. Accordingly, the front ends 22 of the two tubular extension arms 20 can pass over the wooden jaws 14, 16 of the hand screw clamp 10. In the shown embodiment, the tubular extension arms 20 have a generally square cross-sectional shape. Such a shape is merely exemplary and is convenient for engaging wooden jaws of a similar cross-sectional shape. It should be understood that the tubular extension arms 20 can have any cross-sectional shape, provided the tubular extension arms 20 are capable of passing over the wooden jaws 14, 16 of the hand screw clamp 10.

Threaded shafts 12 pass between the wooden jaws 14, 16 of the hand screw clamp 10. The presence of the threaded shafts 12 would normally prevent another object from passing around the wooden jaws 14, 16. However, slots 24 are formed in the tubular extension arms 20. The slots 24 extend from the open front end 22 of the tubular extension arms 20 inwardly to a predetermined distance D1. The distance D1 is at least as long as the distance D2 on the hand screw clamp 10 between the first and second threaded shaft 12. Accordingly, when the tubular extension arms 20 are placed over the wooden jaws 14, 16 of the hand screw clamp 10, both the threaded shafts 12 pass into the slots 24 of the tubular extension arms 20.

Once the tubular extension arms 20 are attached to the wooden jaws 14, 16 of the hand screw clamp 10, the tubular extension arms 20 become the new jaw elements of the hand screw clamp 10. The effective length of the hand screw clamp 10 is therefore greatly increased. As a result, the hand screw clamp 10 can be used to clamp together objects much farther away from the base of the clamp than was previously possible. The new effective reach of the hand screw clamp 10 is determined by the length of the tubular extension arms 20, which can be any length from a few inches to a few feet.

Figure 3:
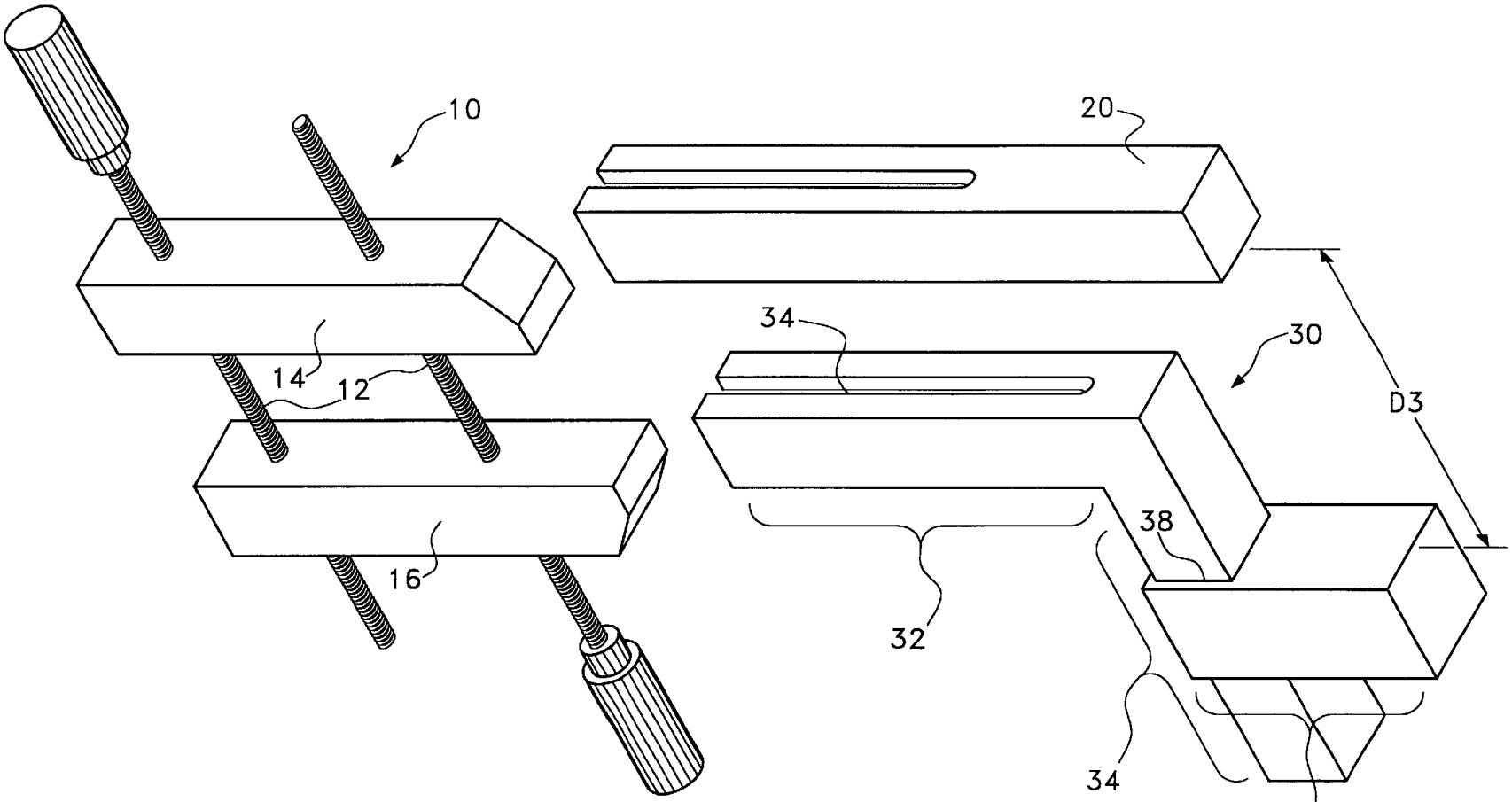
FIG. 3 is perspective view of an alternate exemplary embodiment of a clamp extension system in accordance with the present invention.

Referring to FIG. 3, it can be seen that the extensions that attach to the wooden jaws 14, 16 of the hand screw clamp 10 need not be linear. In the embodiment of FIG. 3, the top tubular extension arm 20 has the same linear configuration as was previously described in connection with FIG. 2. The lower extension element 30, however, is not linear in shape. Rather, the lower extension element 30 is comprised of three separate sections. The top section 32 of the extension element 30 is linear in shape and is tubular. A slot 34 is formed in the top section 32 for receiving the threaded shafts 12 of the hand screw clamp 10. The top section 32 of the extension element 30 interconnects with the hand screw clamp 10 in the same manner as has been previously described.

A vertical section 34 extends downwardly from the top section 32 of the extension element 30. The vertical section 34 can either be permanently affixed to the top section 32 or selectively attachable to the top section 32. A movable extender arm 36 attaches to the vertical section 34 of the extension element 30. The extender arm 36 can engage the vertical section 34 at any point along the length of the vertical section 34. Accordingly, the distance D3 between the extender arm 36 and the top tubular extension arm 20 can be selectively adjusted to the needs of the user.

There are many different ways that the extender arm 36 can attach to the vertical section 34 of the extension element 30. However, in the shown embodiment, the extender arm 36 has a hollow sleeve 38 that passes around the vertical section 34 of the extension element 30. The area of the opening in the hollow sleeve 38 is only slightly larger than the cross-sectional area of the vertical section 34. Accordingly, the weight of the extender arm 36 causes the hollow sleeve 38 to turn and create an interference fit against the vertical section 34. To adjust the extender arm 36, the extender arm 36 is simply lifted to a point where the interference fit is eliminated and the extender arm 36 is free to move along the vertical section 34.

Figure 4:
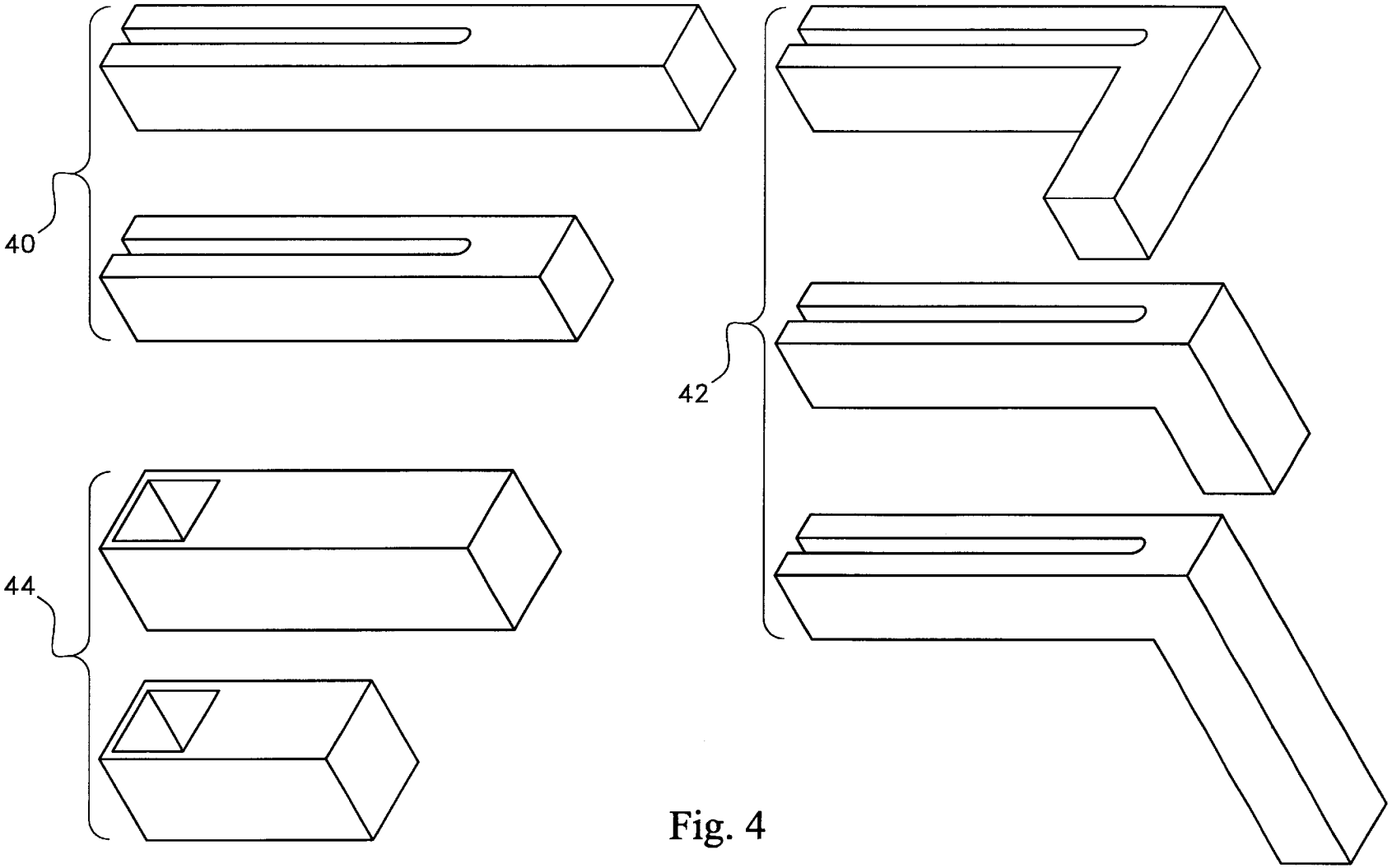
FIG. 4 is a perspective view of a set of clamp extension components in accordance with the present invention.

Referring to FIG. 4, it can be seen that the present invention clamp extension system can have a variety of components. The components include linear tubular extension arms 40 that attach to the wooden jaws of the hand screw clamp, shaped extension elements 42 that attach to the wooden jaws of the hand screw clamp and extender arms 44 that can attach to either the linear tubular extension arms 40 or the shaped extension elements 42. The linear tubular extension arms 40 and the extender arms 44 can come in a variety of lengths. The shaped extension elements 42 can come in a variety of both lengths and configurations. By selectively utilizing each of the elements, a carpenter can configure the clamp extension system to match his/her clamping needs.

By utilizing the present invention clamp extension system, the shape of a traditional clamp can be changed into numerous different configurations. Accordingly, the versatility and utility of a traditional clamp is greatly increased. A carpenter therefore does not need to purchase or build multiple different clamps for different clamping needs. Rather, a single clamp can be reconfigured to the size and shape required.

It will be understood that the specifics of the present invention described above illustrate only exemplary embodiments of the present invention. A person skilled in the art can therefore make numerous alterations and modifications to the shown embodiments utilizing functionally equivalent components to those shown and described. All such modifications are intended to be included within the scope of the present invention as defined by the appended claims.

What is claimed is:

1. An extension system for a hand screw clamp of the type having two jaw elements interconnected by two threaded shafts, said system comprising:

a first tubular element having an open end and two opposing slots that extend inwardly a predetermined distance from said open end, wherein said open end is sized to receive a first of the jaw elements therein;

a second tubular element having an open end, a second end opposite said open end and two opposing slots that extend from said open end a predetermined distance toward said second end, wherein said open end is sized to receive a second of the jaw elements therein; and an extension element that extends at an angle from said second tubular element, proximate said second end.

2. The system according to claim 1, wherein said opposing slots on said first tubular element are sized to receive the threaded shafts of the hand screw clamp therein when said first tubular element is advanced over a first of said jaw elements of said hand screw clamp.

3. The system according to claim 2, wherein said opposing slots on said second tubular element are sized to receive the threaded shafts of the hand screw clamp therein when said second tubular element is advanced over a second of said jaw elements of said hand screw clamp.

4. The system according to claim 1, wherein the jaws of the hand screw clamp have a predetermined cross-sectional shape and both said first tubular element and said second tubular element define interior areas having a cross-sectional shape complimentary to said predetermined cross-sectional shape.

5. The system according to claim 1, wherein said first tubular element and said second tubular element are both linear in configuration.

6. The system according to claim 1, wherein said second tubular element contains at least one right angle turn between said open end and said second end.

7. The system according to claim 1, wherein said first tubular element is linear and said second tubular element contains at least one right angle turn between said open end and said second end.

8. A clamping system, comprising:

a hand screw clamp having a first jaw element, a second jaw element and two threaded shafts that interconnect said first jaw element and said second jaw element;

a first extension element having a first open end and a first two opposing slots that extend inwardly a predetermined distance from said first open end, wherein said first open end is sized to receive said first jaw element therein and said first two opposing slots are oriented and sized to receive said two threaded shafts therein;

a second extension element having a second open end and a second two opposing slots that extend inwardly a predetermined distance from said second open end, wherein said second open end is sized to receive said second jaw element therein and said second two opposing slots are oriented and sized to receive said two threaded shafts therein.

9. The system according to claim 8, wherein said first jaw element and said second jaw element of said hand screw clamp have a predetermined cross-sectional shape and both said first extension element and said second extension element define interior areas having a cross-sectional shape complimentary to said predetermined cross-sectional shape.

10. The system according to claim 8, wherein said second extension element has a second end opposite said second open end and includes an arm element that extends at an angle from said second extension element, proximate said second end.

11. The system according to claim 8, further including at least one arm element that can be selectively attached to said first extension element and said second extension element at a variety of points.

12. The system according to claim 8, wherein said first extension element and said second extension element have a linear configuration.

13. The system according to claim 8, wherein said second extension element has a second end and said second extension element contains at least one right angle turn between its open end and said second end.

14. The system according to claim 8, wherein said first extension element is linear and said second extension element contains at least one right angle turn between said open end of said second extension element and a second end of said second extension element.

15. An extension system for a hand screw clamp of the type having two jaw elements interconnected by two threaded shafts, said system comprising:

a first tubular element having an open end and two opposing slots that extend inwardly a predetermined distance from said open end, wherein said open end is sized to receive a first of the jaw elements therein;

a second tubular element having an open end and two opposing slots that extend inwardly a predetermined distance toward said second end, wherein said open end is sized to receive a second of the jaw elements therein; and at least one extension element that can be selectively attached to either said first tubular element or said second tubular element at a variety of points.

* * * * *